United States Patent [19]
Vorbach et al.
[11] 4,197,026
[45] Apr. 8, 1980

[54] DEVICE FOR HOLDING DOWN COPY MATERIAL IN SHEET FORM FOR OFFICE, DATA, OR TELEX MACHINES

[75] Inventors: Günther Vorbach, Schwindegg; Albert Chocholaty, Munich, both of Fed. Rep. of Germany

[73] Assignee: Siemens Aktiengesellschaft, Berlin & Munich, Fed. Rep. of Germany

[21] Appl. No.: 821,914

[22] Filed: Aug. 4, 1977

[30] Foreign Application Priority Data

Sep. 8, 1976 [DE] Fed. Rep. of Germany ..... 2640445

[51] Int. Cl.[2] ..... B41J 11/36
[52] U.S. Cl. ..... 400/718; 248/442.2
[58] Field of Search ..... 197/180, 181.1, 181.2; 312/208; 40/341; 248/441 R, 441 A, 442.2, 447, 450, 451, 452, 453, 454, 455, 456, 457, 458, 459, 460, 461, 462

[56] References Cited

U.S. PATENT DOCUMENTS

| | | | |
|---|---|---|---|
| 693,124 | 2/1902 | Forney | 197/181.1 |
| 766,752 | 8/1904 | Bonine | 248/442.2 |
| 834,262 | 10/1906 | Chrisman | 248/442.2 |
| 1,042,373 | 10/1912 | Horne | 248/452 X |
| 1,181,537 | 5/1916 | Osborn | 197/180 X |
| 1,203,354 | 10/1916 | Kaufman | 248/442.2 |
| 1,221,369 | 4/1917 | Osborn | 248/442.2 |
| 1,328,476 | 1/1920 | Averill | 248/442.2 X |
| 1,615,959 | 2/1927 | Slavik | 248/442.2 |
| 1,784,253 | 12/1930 | Schano | 312/208 |
| 2,232,904 | 2/1941 | Doria | 248/452 X |
| 2,971,628 | 2/1961 | Griffith | 197/181.1 X |
| 3,060,893 | 10/1962 | Wintermeyer | 248/442.2 |

FOREIGN PATENT DOCUMENTS

| | | | |
|---|---|---|---|
| 2316077 | 10/1974 | Fed. Rep. of Germany | 197/181.1 |

*Primary Examiner*—Ernest T. Wright, Jr.
*Attorney, Agent, or Firm*—Hill, Van Santen, Steadman, Chiara & Simpson

[57] ABSTRACT

A device for holding copy material in sheet-form for use with office, data, telex machines and the like, which is so constructed that a curve is formed in the supported copy sheet which extends parallel to the line direction thereof, whereby the copy sheet is sufficiently stiffened by such curve that the holding device may directly support merely a portion of the copy sheet. Preferably, the supporting surface for the sheet is formed in two sections, one of which may be a portion of the housing of the machine and the other section constructed for disposition in either an operative or a folded down position.

19 Claims, 5 Drawing Figures

DEVICE FOR HOLDING DOWN COPY MATERIAL IN SHEET FORM FOR OFFICE, DATA, OR TELEX MACHINES

BACKGROUND OF THE INVENTION

1. Field of the Invention

The invention relates to a device for holding copy material, in sheet form, for use in connection with office, data or telex machines, whereby the copy material is securely supported on a suitable supporting surface by means of a restraining device, whereby the copy material is effectively supported for reading while the machine involved is being operated.

2. The Prior Art

Apart from the possibility of positioning written material directly adjacent to or on parts of the housing of the typewriters or similar machines, or of securing them thereon, it is known to provide individual copy holders which are operable to support sheet material, which copy holders either have to be attached to the machine before a typing operation, or may form a part of the machine and accordingly sometimes must be disposed in the desired working position, entailing a considerable amount of bother. The effort required in setting such copy holders in a favorable working position is normally such that as a result, the advantage of good legibility during the typing operation is to a large extent lost, particularly with typing jobs that are short.

SUMMARY OF THE INVENTION

The invention has among its objectives the production of an arrangement for supporting typed copy, in connection with the operation of typewriters and similar machines, as for example data or telex machines, which supports the typed copy in a position which provides optimum visibility and legibility during typing operations on the machine. It has been proved expedient to dispose copy material of this type close to the point at which a typewriter types, i.e. in a position which, insofar as practical, corresponds to the position of the sheet being typed, whereby the text to be copied and the typed text are closely adjacent one another and thus can be compared without changing head position and with a minimum angular movement of the eyes. However, in this case the copy supporting structure as well as the copy itself, must be in a position that will not obscure the point of typing, or the sheet receiving the typing.

A device, constructed in accordance with the above and which fulfills the particular requirements is, in accordance with the invention, so constructed that the width of the supporting surface for the copy material is relatively narrow, as compared with the width of the copy sheet. The supporting face is formed in two sections to provide a curve or bend in a sheet supported thereby, which bend extends substantially parallel to the direction of the lines of the copy material, whereby the portions of the copy sheet at opposite sides of such curve extend transversely to one another, with a restraining device for the copy sheet being disposed at least in the vicinity of such curve or bend.

A device embodying such features, in accordance with the invention, may be relatively narrow in construction and adapted to directly support a copy sheet along a narrow area extending in lengthwise direction, forming a curve or bend in the sheet whereby the free part of the sheet is adequately stiffened to render it self-supporting. Thus the copy sheet may be directly supported merely along one side with the remaining, major part of the sheet projecting laterally beyond the supporting structure. As a result, the copy holder can be disposed in lateral areas of the typewriter without the holder extending beyond the lateral sides of the typewriter, while the copy sheets can be so supported by the device that they may project laterally beyond the typewriter housing, taking up a relatively little space on the typewriter.

In a preferred embodiment of the invention, the supporting surface for the copy sheet comprises two sections, one of which is formed by a substantially horizontal part of the housing of the typewriter, and the other section being operatively aligned with the first section and extending obliquely upwards therefrom at an obtuse angle.

In accordance with the invention, the construction preferably is such that the upwardly extending supporting face carries a restraining structure for retaining the copy sheet in position on the supporting surface, with the section of the supporting surface carrying such restraining structure being disposed adjacent the point of emergence of the sheet being typed upon in the machine.

Preferably the section of the supporting surface extending obliquely upward from the other section of the supporting surface, formed by a portion of the housing of the machine, is constructed in the form of an elongated supporting strip that can be moved into a folded position or in an operative position substantially parallel to the adjacent portion of the typewriter housing. Preferably, the strip is supported by a resilient mounting carried by the typewriter housing, with small protuberances being disposed on the supporting strip cooperable, for example, with an adjacent portion of the housing of the machine for retaining the strip in either its operative or folded positions. The restraining structure carried by the strip preferably is provided with a convex curvature whereby its edges do not undesirably stand out and possibly affect the legibility of the material being retained.

In accordance with an additional feature of the invention, utilizing a supporting strip mounted on the housing of the typewriter, the strip is provided with conically tapering guide contours for the bearing bracket which, in operative position of the strip, present adequate clearance to enable a swiveling movement of the supporting strip relative to the housing, but present relatively narrow contours for the bearing bracket when the strip is in its rest or inoperative position. Consequently when the supporting strip is in operative position, it can be swiveled or tilted to permit the copy sheet to be adjusted with respect to the operator's vision while, when folded back into its rest position, it is necessarily aligned with and disposed adjacent the section of the supporting surface formed by the housing, and thus in a relatively fixed position.

In accordance with a further feature of the invention, the supporting surface, in particular the supporting strip, is provided with an elongated groove-like depression having a flat bottom wall, with the restraining structure carried by the supporting strip being disposed in such depression. This construction intensifies the clamping effect on the copy exerted by the restraining structure in cooperation with the supporting surface. Preferably the restraining structure is constructed of a semi-resilient, transparent material and has a convex curvature formed on a longitudinally extending axis whereby the typed content disposed therebeneath can be readily recognized and the presence of such edges are minimized.

BRIEF DESCRIPTION OF THE DRAWING

In the drawing, wherein like reference characters indicate like or corresponding parts.

DETAILED DESCRIPTION OF THE INVENTION

Figure 1:
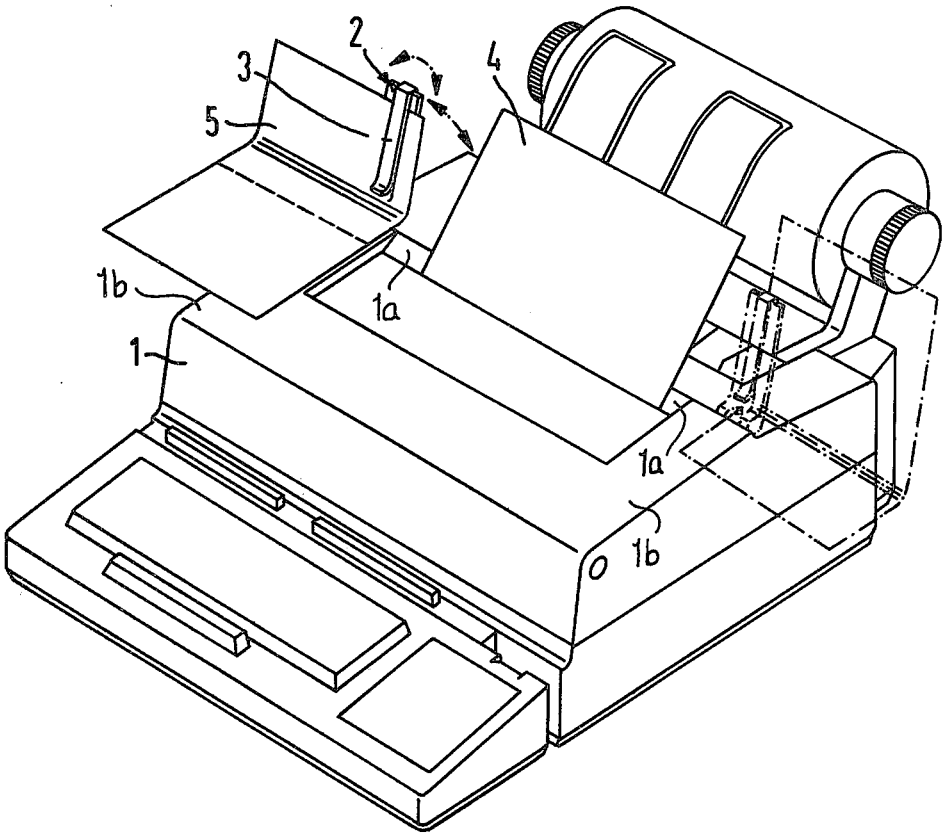
FIG. 1 is a perspective view of a telex machine or the like embodying a copy holder in accordance with the present invention.
Figure 5:
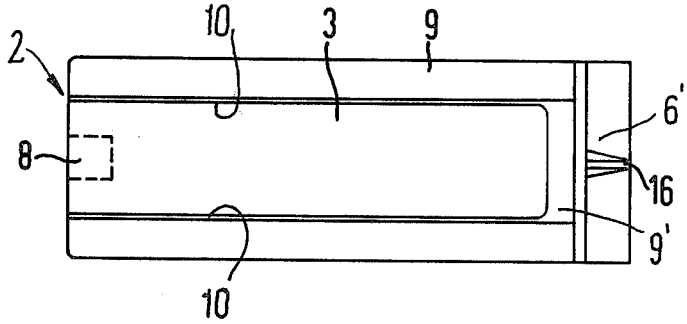
FIG. 5 is a top or plan view of the supporting strip carrying the restraining structure.

Referring to FIG. 1, the reference numeral 1 designates the housing of a telex machine which is provided with a supporting strip, generally indicated by the reference numeral 2 carrying a restraining structure, illustrated as being in the form of an arm 3, with the supporting strip 2 being disposed on the top of the housing 1 adjacent the opening 1*a* through which a typed carrier sheet 4 emerges. The sheet 5 of copy material is inserted beneath the restraining structure 3, with the adjacent edge portion of the sheet 5 held against the supporting strip 2 by the restraining arm 3. As the supporting strip 2 is shorter than the length of the copy material 5, the latter at the bottom of the restraining arm 3 is bent forward at an obtuse angle by the portion 1*b* of the housing 1 of the telex machine. The copy sheet 5, as a result of the curve or bend therein, is thereby materially stiffened whereby the portion of the sheet 5 projecting laterally beyond the supporting strip 2 and the portion 1*b* of the housing 1 of the telex machine possesses adequate inherent rigidity and stability of form that it may be readily retained in operative position. The sheet 5 illustrated represents a standard sheet of paper of letter or legal size while the broken line indicates a half sheet and thus the bottom edge of a correspondingly sized sheet commonly used for billing, invoicing and other purposes. Thus, even a small sheet will still receive an adequate stabilizing configuration.

As illustrated in broken lines in FIG. 1, the copy holder can also be disposed in the vicinity of the point of emergence of the sheet 4 at the right hand side of the housing 1 of the telex machine.

It will be apparent from the above that the device comprises a supporting surface for the copy sheet 5, which surface comprises two sections, one of which, i.e. the substantially horizontal surface, being formed by the adjacent portion 1*b* of the housing 1, with the other section comprising the supporting strip 2 which is provided with the restraining arm 3.

FIGS. 2–5 illustrate details of a preferred embodiment of the invention in which the supporting strip 2 and restraining arm 3 are formed as two individual members each produced from transparent material by an injection molding or the like. One member comprises a pair of parallel arms 3 and 6 which are connected by a yoke section 8 at the top of the structure, with the arm 3 thus forming the restraining structure for the copy sheet 5. The free end of the other arm 6 is extended to form a portion of a bearing seat 6′, a cooperable complementary portion of which seat 6′ is formed by a portion 9′ of a flat member 9 which is disposed and locked between the arms 6 and 3. The member 9, of the supporting strip 2, forms one section of the supporting surface and the portion thereof disposed in opposition with the retaining arm 3 is provided with a flat channel-shaped recess 10, particularly illustrated in FIG. 3. It will be appreciated that as the portion of the copy sheet 5 disposed between the bottom of the recess 10 and the adjacent face of the restraining arm 3 deforms the portion of the sheet 5 thereat out of its normal plane, the clamping effect between the arm 3 and the arm 6 is increased. As will be apparent from a reference to FIG. 3, the restraining arm 3, made from transparent plastic or the like, is provided with a convex surface which is curved about its longitudinal axis. As a result, no raised or projecting side edges are formed on the arm 3, whereby the view of the copy sheet 5 is not materially impaired even though the restraining arm 3 is disposed over the typed area.

It will be noted that the yoke section 8 is considerably less in width than the arm 3 to form slots or apertures at the top of the supporting strip 2 and the restraining structure 3 whereby a copy sheet 5 may also be firmly held by the structure 3 with the sheet 5 disposed at one side of the yoke section 8 and extending thereabove, as illustrated in FIG. 1 in broken lines. Thus insertion of the sheet 5 into the restraining structure 3 is not limited to the disposition of a sheet 5 with its upper edge abutting the yoke 8.

Figure 2:
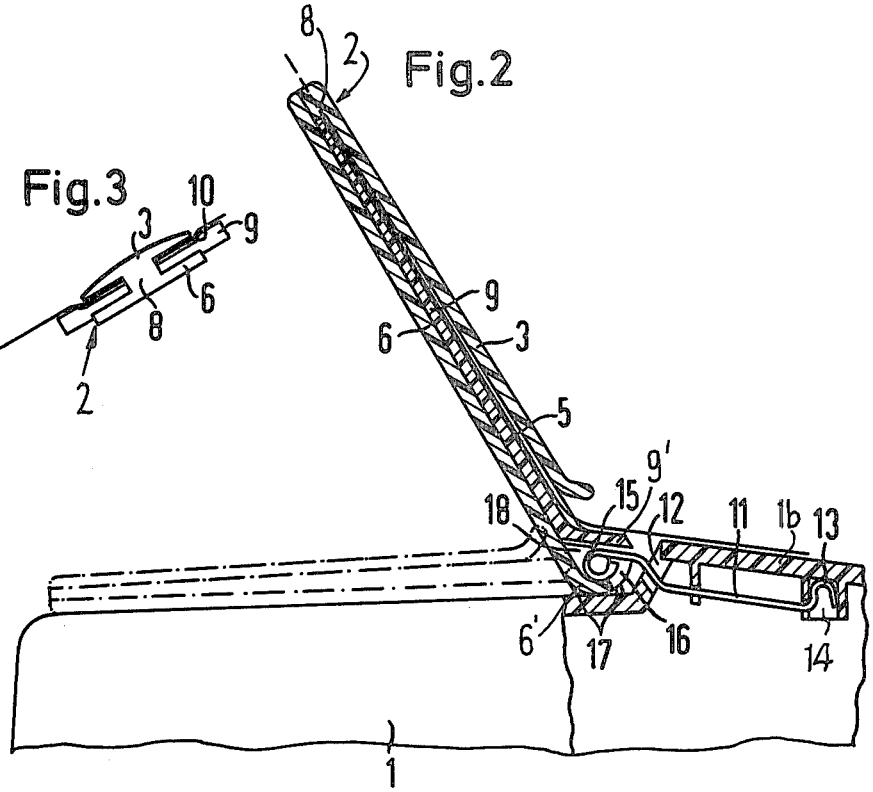
FIG. 2 is a side elevation of a portion of the housing of a telex machine with the copy holding device and associated portion of the housing being illustrated in section.
Figure 3:
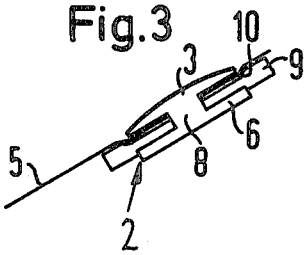
FIG. 3 is an end view of the supporting strip and associated sheet-restraining structure.

The strip 2 and associated structure is adapted to be supported from the housing 1 of the telex machine by a suitable mounting 11, which may be formed from spring-steel wire, one end of which extends through an opening 12 into the interior of the housing 1 and is secured thereto by a U-shaped portion 13 in the extreme free end of the wire, which U-shaped portion 13 is disposed within a molded recess 14 formed in the underside of the housing 1. The opposite end of the mounting 11 projects from the housing 1 and is formed at its extreme end with a loop or eye 15, with the intermediate portion of the mounting 11 extending through a lateral guide slot 16 in the bearing seat 6′ of the copy holding structure. As illustrated in FIG. 2, small protuberances 17 are formed on the end portion of the arm 6 which are adapted to engage the adjacent surface of the housing 1 when the strip 2 is in the position illustrated, and thereby retain the structure in operative position relative to the housing 1.

Figure 4:
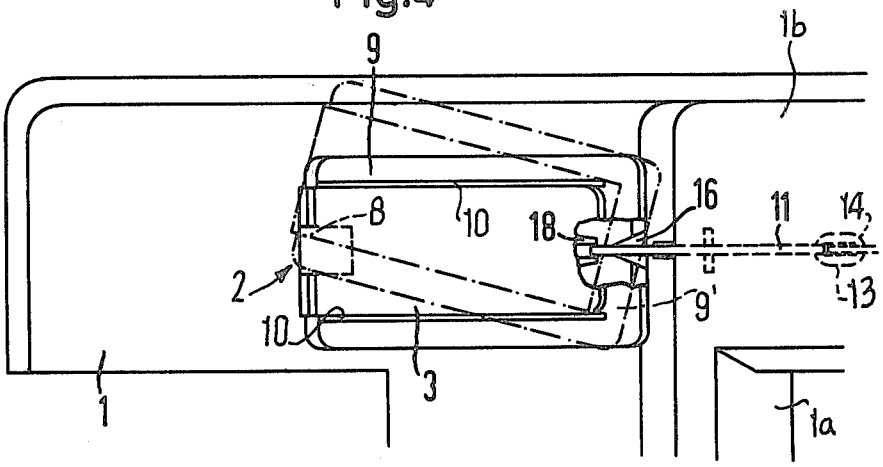
FIG. 4 is a plan view of a portion of a telex machine and copy holder disposed thereon.

As illustrated, the guide edges of the guide slot 16 diverge outwardly whereby the strip 2, when in operative position, can be swiveled to either side from a central position, as illustrated in broken lines in FIG. 4. However, when the strip 2 and associated structure is moved into its rest or folded position as illustrated in broken lines in FIG. 2, the mounting 11 is disposed in a portion of the guide slot 16 of reduced width, whereby the strip 2 and associated parts must be in an aligned position parallel with the side edge of the housing 1 of the telex machine, i.e. cannot be swiveled. As illustrated in FIG. 4, the bearing seat 6′ is provided with internal guiding element 18 which are cooperable with the end of the mounting 11, forming the pivot about which the supporting strip 2 and associated structure may swivel.

Having thus described our invention it will be obvious that although various minor modifications might be suggested by those versed in the art, it should be understood that we wish to embody within the scope of the patent granted hereon all such modifications as reasonably, and properly come within the scope of our contribution to the art.

We claim as our invention:

1. A device for holding sheet-form copy material, for office, data or telex machines, comprising a copy-supporting structure carried by the machine, forming a supporting surface for the copy material, having an approximate length on the order of the length of the copy material normally to be supported thereby, and having a width which is relatively narrow with respect to the width of said copy material, said supporting surface being divided intermediate its length into two portions which extend from their juncture in generally angular relation, with one surface extending from such juncture toward a keyboard end of the machine, and the other surface extending rearward and upwardly from said juncture, tending to form a curve in said normally-sized copy material disposed thereon, which curve extends generally parallel to the line direction of said copy material, the width of each of said portions being sufficiently less than the corresponding dimension of said copy-material, that neither portion is capable of independently operatively supporting said copy material in a planar position, and a retaining structure cooperable with said supporting surface, at least a portion of said retaining structure being disposed in the vicinity of said curve for engagement with the exposed face of said supported copy material, to maintain said curve therein and said copy material on said surface, whereby said curve imparts sufficient rigidity to the sheet-form copy material to render unsupported portions thereof, disposed laterally of said supporting surface, relatively stiff and adequately self-supporting for viewing thereof.

2. A device according to claim 1, wherein the retaining structure is constructed of transparent material, with the copy-engaging portion thereof having a convex external surface curved about the longitudinal axis of the retaining structure to permit viewing of copy material lying underneath said retaining structure.

3. A device according to claim 1, wherein the retaining structure is carried by one of the portions of the supporting surface, that portion carrying the retaining structure being disposed laterally adjacent a point of emergence of a paper sheet being typed on in the machine.

4. A device according to claim 1, wherein one of said portions forming the supporting surface comprises a substantially horizontal face of the machine, and the other portion of the supporting surface is aligned therewith and extends obliquely upwards at an obtuse angle.

5. A device according to claim 4, wherein the retaining structure is carried by one of the portions of the supporting surface, the portion carrying the retaining structure being disposed laterally adjacent a point of emergence of a paper sheet being typed on in the machine.

6. A device according to claim 5, wherein the portion of the supporting surface aligned with and running obliquely upwards from the portion of the supporting surface formed by a face of the machine, is in the form of a movable supporting strip that can be moved into a rest position substantially parallel to a portion of the machine.

7. A device according to claim 6, wherein the retaining structure and the supporting strip are connected and have guide openings for a paper sheet at opposite sides of the connection therebetween, whereby a copy sheet may be engaged therewith anywhere along a lateral edge thereof.

8. A device according to claim 6, wherein the retaining structure is in the form of a retaining strip, having inherent resilience, which is secured to the supporting strip at the top end thereof, and extends therefrom to adjacent the juncture of the two portions forming the supporting surface.

9. A device according to claim 6, wherein the retaining structure is constructed of transparent material, with the copy-engaging portion thereof having a convex external surface curved about the longitudinal axis of the retaining structure.

10. A device for holding sheet-form copy material for office, data or telex machines comprising a copy-supporting structure carried by the machine, whereby the copy material is thereby partially disposed on a supporting surface, the effective width of which is relatively narrow as compared with the corresponding width of the copy material, said supporting surface having two portions which are disposed transversely to one another to form a curve in copy material, disposed therein which extends generally parallel to the line direction of said copy material, one of said portions forming the supporting surface comprising a substantially horizontal face of a housing of the machine, the other portion of the supporting surface being aligned therewith and extending obliquely upwards at an obtuse angle, and in the form of a movable supporting strip that can be moved into a rest position substantially parallel to a portion of the machine housing, and a retaining structure, cooperable with said supporting surface for retaining copy material thereon, at least a portion of said structure being disposed in the vicinity of said curve, said retaining structure being carried by one of the portions of the supporting surface, that carrying the retaining structure being disposed laterally adjacent a point of emergence of a paper sheet being typed on in the machine, said supporting strip and the retaining structure being formed by respective parallel arms which are connected at their top ends by a yoke section, one of which arms forms the retaining structure, and the other of which arms is provided at its free end with means forming a part of a bearing seat, and a relatively flat member forming an adjacent portion of the supporting surface, disposed between the two arms and provided with means forming a complementary part of said bearing seat.

11. A device for holding sheet-form copy material for office, data or telex machines comprising a copy-supporting structure carried by the machine, whereby the copy material is thereby partially disposed on a supporting surface, the effective width of which is relatively narrow as compared with the corresponding width of the copy material, said supporting surface having two portions which are disposed transversely to one another to form a curve in copy material, disposed therein which extends generally parallel to the line direction of said copy material, one of said portions forming the supporting surface comprising a substantially horizontal face of a housing of the machine, the other portion of the supporting surface being aligned in the form of a movable supporting strip with said one portion and extending obliquely upwards at an obtuse angle, and can be moved into a rest position substantially parallel to a portion of the machine housing, said supporting strip being provided with a guide slot, for receiving means for mounting said supporting strip on the machine, which slot has conically converging guide edges relatively widely spaced with respect to said mounting means in the operative position and fit snugly adjacent said mounting means in the rest position, and a retaining structure, coooperable with said supporting surface for retaining copy material thereon, at least a portion of said structure being disposed in the vicinity of said curve, said retaining structure being carried by one of the portions of the supporting surface, that carrying the retaining structure being disposed laterally adjacent a point of emergence of a paper sheet being typed on in the machine.

12. A device for holding sheet-from copy material for office, data or telex machines comprising a copy-supporting structure carried by the machine, whereby the copy material is thereby partially disposed on a supporting surface, the effective width of which is relatively narrow as compared with the corresponding width of the copy material, said supporting surface having two portions which are disposed transversely to one another to form a curve in copy material, disposed therein which extends generally parallel to the line direction of said copy material, one of said portions forming the supporting surface comprising a substantially horizontal face of a housing of the machine, the other portion of the supporting surface being aligned therewith and extending obliquely upwards at an obtuse angle, and in the form of a movable supporting strip that can be moved into a rest position substantially parallel to a portion of the machine housing, reslient mounting means carried by the machine for supporting said strip, and relatively small protuberances disposed on said supporting strip in the area adjacent the mounting point thereof, operative for determining the operative and rest positions thereof, and a retaining structure, cooperable with said supporting surface, for retaining copy material thereon, at least a portion of said structure being disposed in the vicinity of said curve, said retaining structure being carried by one of the portions of the supporting surface, that carrying the retaining structure being disposed laterally adjacent a point of emergence of a paper sheet being typed on in the machine.

13. A device according to claim 12, wherein the supporting strip is provided with a guide slot for the mounting means, which has conically converging guide edges, which edges are relatively widely spaced with respect to the mounting means in the operative position and fit snuggly adjacent the mounting means in the rest position.

14. A device according to claim 13, wherein the retaining structure is in the form of a retaining strip, having inherent resilience, which is secured to the supporting strip at the top end thereof, and extends therefrom to adjacent the juncture of the two portions forming the supporting surface.

15. A device according to claim 14, wherein the supporting strip is provided with a flat channel-shaped recess cooperable with the retaining strip.

16. A device according to claim 15, wherein the retaining structure and the supporting strip have guide openings for a paper copy sheet at opposite sides of the connection therebetween, whereby a copy sheet may be engaged therewith anywhere along a lateral edge thereof.

17. A device according to claim 15, wherein the supporting strip and the retaining structure are formed by respective parallel arms which are connected at their top ends by a yoke section, one of which arms forms the retaining structure, and the other of which arms is provided at its free end with means forming a part of a bearing seat, and a relatively flat member forming an adjacent portion of the supporting surface, disposed between the two arms and provided with means forming a complementary part of said bearing seat.

18. A device according to claim 17, wherein the retaining strip is constructed of transparent material, with the copy-engaging portion thereof having a convex external surface curved about the longitudinal axis of the retaining strip.

19. A device for holding sheet-form copy material for office, data or telex machines comprising a copy-supporting structure carried by the machine, whereby the copy material is thereby partially disposed on a supporting surface, the effective width of which is relatively narrow as compared with the corresponding width of the copy material, said supporting surface having two portions which are disposed transversely to one another to form a curve in copy material, disposed therein which extends generally parallel to the line direction of said copy material, one of said portions forming the supporting surface comprising a substantially horizontal face of a housing of the machine, the other portion of the supporting surface being aligned therewith and extending obliquely upwards at an obtuse angle, and in the form of a movable supporting strip that can be moved into a rest position substantially parallel to a portion of the machine housing, and a retaining structure, cooperable with said supporting surface for retaining copy material thereon, at least a portion of said structure being disposed in the vicinity of said curve, said retaining structure being carried by one of the portions of the supporting surface, that carrying the retaining structure being disposed laterally adjacent a point of emergence of a paper sheet being typed on in the machine, said supporting strip being provided with a flat channel-shaped recess cooperable with the retaining structure.

* * * * *